US010227218B1

(12) United States Patent
Stone

(10) Patent No.: US 10,227,218 B1
(45) Date of Patent: Mar. 12, 2019

(54) UNIVERSAL SLAB REMOVAL DEVICE

(71) Applicant: Joshua J. Stone, Harris, MN (US)

(72) Inventor: Joshua J. Stone, Harris, MN (US)

( * ) Notice: Subject to any disclaimer, the term of this patent is extended or adjusted under 35 U.S.C. 154(b) by 0 days.

(21) Appl. No.: 15/728,531

(22) Filed: Oct. 10, 2017

(51) Int. Cl.
*B66C 1/66* (2006.01)
*E04G 21/14* (2006.01)

(52) U.S. Cl.
CPC ..... *B66C 1/666* (2013.01); *E04G 21/142* (2013.01); *E04G 21/147* (2013.01)

(58) Field of Classification Search
CPC .. B66C 1/66; B66C 1/34; E04G 21/16; E04G 21/168; E04G 15/04; E04G 21/142; E04G 21/147; E04B 1/41; E02D 35/005; E02D 35/00
USPC ... 52/125.1, 125.2, 125.3, 125.4, 125.5, 704
See application file for complete search history.

(56) References Cited

U.S. PATENT DOCUMENTS 2,794,336 A * 6/1957 Ballou ..... E04G 21/142 294/81.4
4,367,892 A * 1/1983 Holt ..... B66C 1/666 294/82.31
4,627,198 A * 12/1986 Francies, III ..... B66C 1/666 264/256
4,992,005 A * 2/1991 Hilfiker ..... B66C 1/66 294/89
6,092,849 A * 7/2000 Zambelli ..... E04G 21/142 294/82.1
6,347,904 B1 * 2/2002 Knighton ..... E04C 5/166 248/65
6,513,847 B2 * 2/2003 Harris ..... B66C 1/66 294/63.1
6,694,680 B2 * 2/2004 Zambelli ..... E04G 21/142 294/89
6,752,566 B2 * 6/2004 Smith ..... E01C 11/14 404/73
7,905,063 B2 * 3/2011 Kelly ..... B66C 1/666 52/125.1
2010/0058677 A1 * 3/2010 Arteon ..... E04G 21/142 52/122.1
2015/0167260 A1 * 6/2015 Siqueiros ..... E01C 5/06 404/73

* cited by examiner

*Primary Examiner* — Beth A Stephen
(74) *Attorney, Agent, or Firm* — Dave Alan Lingbeck

(57) ABSTRACT

A universal slab removal device for picking up and moving large slabs of cement, concrete or any other types of heavy solid material using any type of lifting machine. The universal slab removal device includes an anchor assembly including an elongated anchor member adapted to be fastened to a slab of heavy solid material such as cement, pavement, and stone and be lifted with a lifting apparatus such as a fork lift and the like.

9 Claims, 4 Drawing Sheets

UNIVERSAL SLAB REMOVAL DEVICE

BACKGROUND OF THE INVENTION

Field of the Invention

The present invention relates to slab removal devices and more particularly pertains to a new universal slab removal device for picking up and moving large slabs of cement, concrete or any other types of heavy material using any type of lifting machine.

Description of the Prior Art

The use of slab removal devices is known in the prior art. More specifically, slab removal devices heretofore devised and utilized are known to consist basically of familiar, expected and obvious structural configurations, notwithstanding the myriad of designs encompassed by the crowded prior art which have been developed for the fulfillment of countless objectives and requirements.

The prior art includes at least one longitudinal gripping member and preferably a pair of longitudinal gripping members in spaced apart relationship, which are anchored to a slab of concrete. The apparatus includes a central tunnel or channel for receiving a fork of a forklift, a pair of side members which permit the apparatus to be affixed to the concrete using anchor bolts, and a pair of covering members which cover the area of the anchor bolts to prevent them from flying out and injuring someone if one or more of the anchor bolts should shear loose during the lifting or moving process. Another prior art includes apparatuses each having a hollow threaded sleeve extending through the panel to receive a removable threaded lifting bolt by which to establish a lifting point at which a lifting force is applied to lift and position the panel on support blocks seated on the road bed. When the threaded lifting bolt is removed from each hollow threaded sleeve, grout is pumped through the panel by way of the hollow sleeve to fill the space established by the support blocks between the panel and the road bed. Also, another prior art includes a lift attachment including a frame, a base portion extending forward from the bottom of the frame, a lifter portion hingedly attached to the top of the frame, and a hydraulic cylinder for moving the lifter portion from a down position to a raised position. While these devices fulfill their respective, particular objectives and requirements, the aforementioned patents do not disclose a new universal slab removal device.

SUMMARY OF THE INVENTION

The general purpose of the present invention, which will be described subsequently in greater detail, is to provide a new universal slab removal device which has many of the advantages of the slab removal devices mentioned heretofore and many novel features that result in a new universal slab removal device which is not anticipated, rendered obvious, suggested, or even implied by any of the prior art slab removal devices, either alone or in any combination thereof. The present invention includes an anchor assembly including an elongated anchor member adapted to be fastened to a slab of heavy solid material such as cement, pavement, and stone and be lifted with a lifting, apparatus such as a fork lift and the like. None of the prior art includes the combination of the elements of the present invention.

There has thus been outlined, rather broadly, the more important features of the universal slab removal device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is art object of the present invention to provide a new universal slab removal device which has many of the advantages of the slab removal devices mentioned heretofore and many novel features that result in a new universal slab removal device which is not anticipated, rendered obvious, suggested, or even implied by any of the prior art slab removal devices, either alone or in any combination thereof.

Still another object of the present invention is to provide a new universal slab removal device for picking up and moving large slabs of cement, concrete or any other types of heavy solid material using, any type of lifting machine.

Still yet another object of the present invention is to provide a new universal slab removal device that easily and removably fastens directing to the top of the slab.

Even still another object of the present invention is to provide a new universal slab removal device that eliminates the need to jack hammer the slabs to be removed.

These together with other objects of the invention, along with the various features of novelty which characterize the invention, are pointed out with particularity in the claims annexed to and forming a part of this, disclosure. For a better understanding of the invention, its operating advantages and the specific objects attained by its uses, reference should be made to the accompanying drawings and descriptive matter in which there are illustrated preferred embodiments, of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
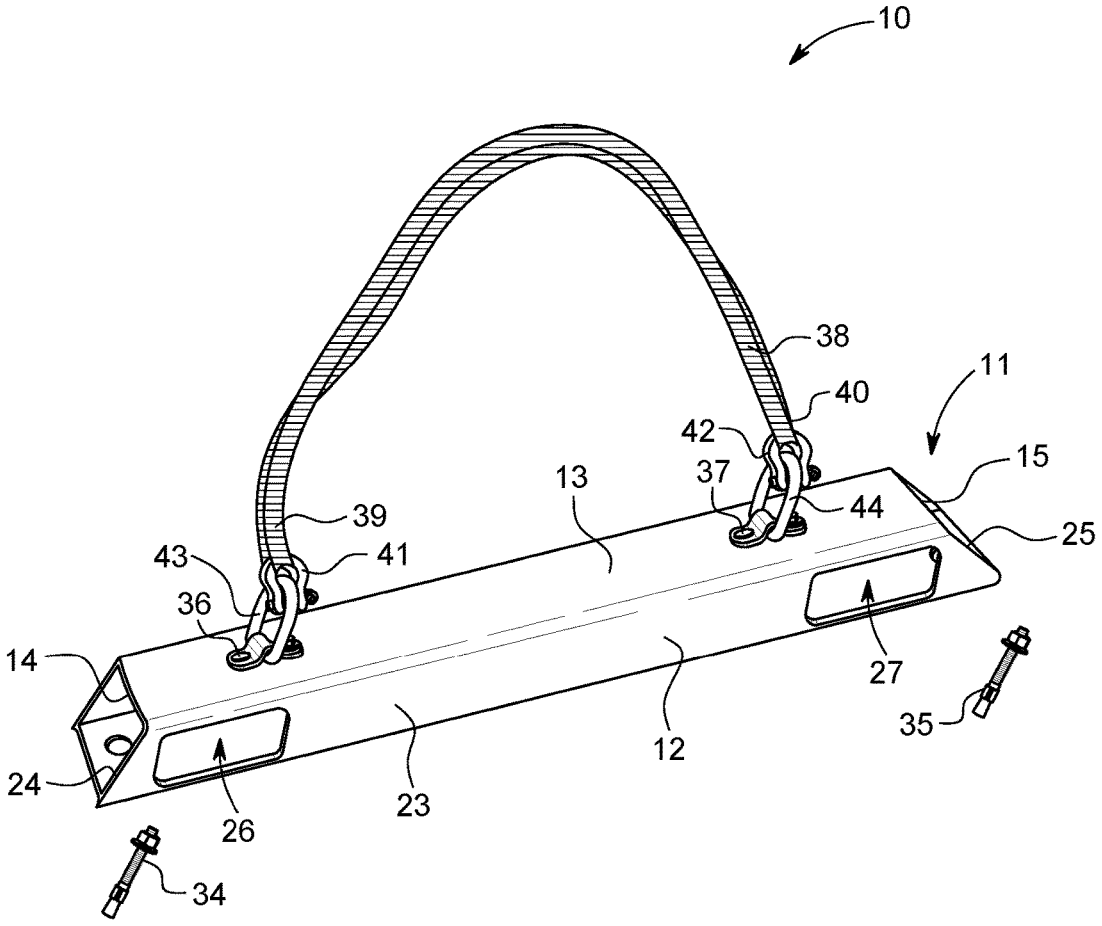
FIG. 1 is a top perspective view of a new universal slab removal device according to the present invention.
Figure 2:
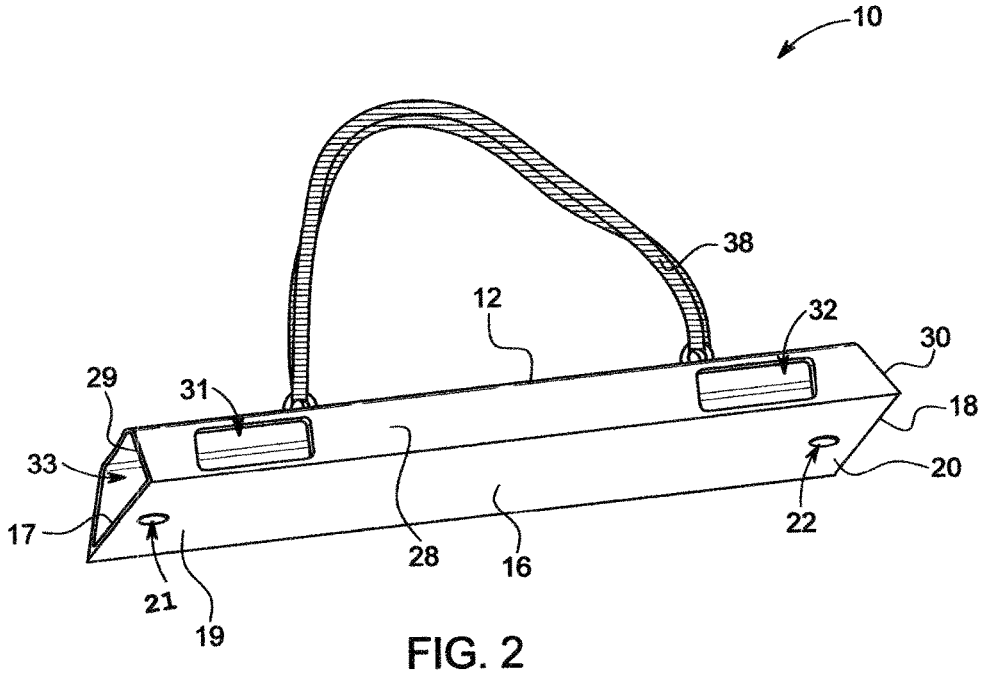
FIG. 2 is a bottom perspective view of the present invention.
Figure 3:
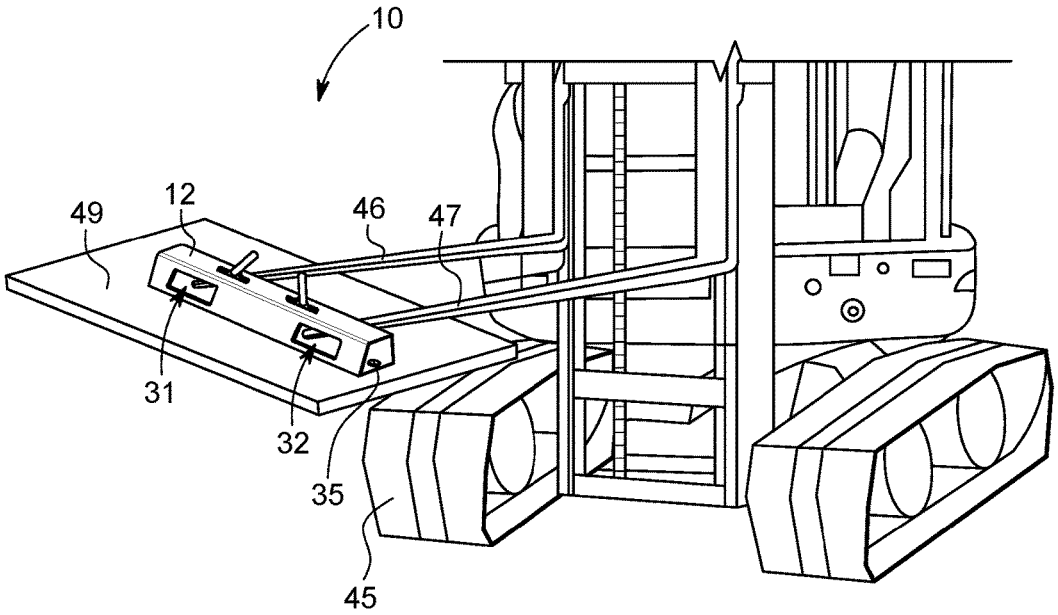
FIG. 3 is a perspective view of the present invention in use.
Figure 4:
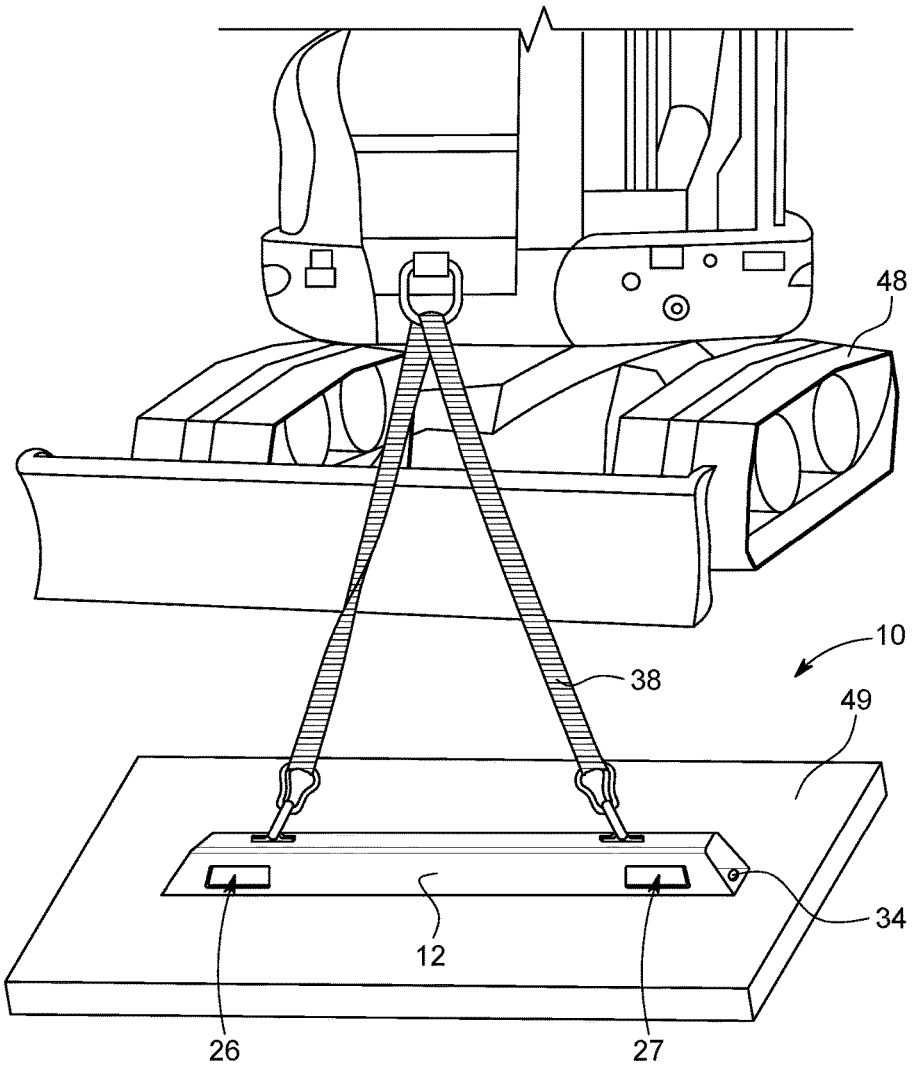
FIG. 4 is another perspective view of the present invention in use.

With reference now to the drawings, and in particular to FIGS. 1 through 4 thereof, a new universal slab removal device embodying the principles and concepts of the present invention and generally designated by the reference numeral 10 will be described.

As best illustrated in FIGS. 1 through 4, the universal slab removal device 10 generally comprises an anchor assembly 11 including an elongated rigid anchor member 12 adapted to be fastened to a slab of heavy solid material 49 such as cement, pavement, and stone and be lifted with a lifting apparatus 48 such as a fork lift 45 and the like. The elongated anchor member 12 has a bottom wall 16, opposed side walls 23, 28, a top wall 13, and a longitudinal bore 33 disposed therethrough. The top wall 13 has opposed ends 14, 15, and the bottom wall 16 has opposed ends 17, 18 and opposed end portions 19, 20 which extend outwardly beyond the ends 14, 15 of the top wall 13 and has holes 21, 22 each disposed through a respective end portion 19, 20 of the bottom wall 16. The holes 21, 22 are disposed beyond the opposed ends 14, 15 of the top wall 13 and vertically aligned and exposed beyond the ends 14, 15 of the top wall 13 and from above the anchor member 12. Each of the side walls 23, 28 has opposed ends 24, 25, 29, 30 and has openings 26, 27, 31, 32 disposed through the side walls 23, 28 with each of the openings 26, 27, 31, 32 being proximate to a respective end 24, 25, 29, 30 of each of the side walls 23, 28 and adapted to receive a fork 46, 47 of the fork lift 45 to lift the anchor member 12 fastened to the slab 49. The ends 24, 25, 29, 30 of the side walls 23, 28 are slanted outwardly from the opposed ends 14, 15 of the top wall 13 to the opposed ends 17, 18 of the bottom wall 16 for strengthening the anchor member 12.

The anchor assembly 11 also includes self-setting concrete anchors 34, 35 removably inserted through the holes 21, 22 in and from above the bottom wall 16 for securing the anchor member 12 to the slab of heavy material 49. The anchor assembly 11 further includes strap connectors 36, 37 spaced apart and conventionally fastened upon the top wall 13 of the anchor member 12 and also includes a strap 38 having opposed ends 39, 40 with couplers 41, 42 conventionally connected at the opposed ends 39, 40 of the strap 38 and further includes rings 43, 44 each conventionally connected to a respective coupler 41, 42 and strap connector 36, 37 for lifting the slab 49 of heavy material using the lifting apparatus 48.

In use, the anchor member 12 is secured upon a slab of heavy solid material 49 by inserting the self-setting concrete anchors 34, 35 into the holes 21, 22 of the anchor member 12 and into the slab of heavy material 49. The anchor member 12 and the slab of heavy solid material 49 is lifted and then moved by either inserting the forks 46, 47 of the fork lift 45 through the openings 26, 27, 3, 32 in the side walls 23, 28 of the anchor member 12 and using the fork lift 45 to lift and move the anchor member 12 and the slab of heavy solid material 49, or conventionally connecting the strap 38 to the lifting apparatus 48 and using the lifting apparatus 48 to raise and move the anchor member 12 and the slab of heavy solid material 49.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the universal slab removal device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A universal slab removal device comprising:

an anchor assembly including an elongated rigid anchor member adapted to be fastened to a slab of heavy solid material such as cement, pavement, and stone and be lifted with a lifting apparatus such as a fork lift, wherein the elongated anchor member has a bottom wall, opposed side walls, a top wall, open ends and a longitudinal bore disposed therethrough, wherein the top wall has opposed ends and the bottom wall has ends and opposed end portions which extend outwardly beyond the ends of the top wall and has holes each disposed through one of said end portions of the bottom wall.

2. The universal slab removal device as described in claim 1, wherein the holes are disposed beyond the opposed ends of the top wall and are vertically aligned and exposed beyond the ends of the top wall and from above the anchor member.

3. The universal slab removal device as described in claim 1, wherein each of the side walls has opposed ends and has openings disposed through the side walls with each of the openings being proximate to one of the ends of each of the side walls and adapted to receive a fork of the fork lift to lift the anchor member fastened to the slab, wherein the ends of the side walls are slanted outwardly from the ends of the top wall to the ends of the bottom wall for strengthening the anchor member.

4. The universal slab removal device as described in claim 1, wherein the anchor assembly also includes self-setting concrete anchors removably inserted through the holes in and from above the bottom wall for securing the anchor member to the slab of heavy solid material.

5. A universal slab removal device comprising: an anchor assembly including an elongated rigid anchor member adapted to be fastened to a slab of heavy solid material such as cement, pavement, and stone and be lifted with a lifting apparatus such as a fork lift, wherein the elongated anchor member has a bottom wall, opposed side walls, a top wall, open ends and a longitudinal bore disposed therethrough wherein the anchor assembly further includes strap connectors spaced apart and fastened upon the top wall of the anchor member and also includes a strap having opposed ends with couplers connected at the opposed ends and further includes rings each connected to said couplers and said connectors for lifting the slab of heavy solid material using the lifting apparatus.

6. A method of using a universal slab removal device comprising the steps of:

providing an elongated anchor member having a top wall, a bottom wall with holes disposed therethrough and also having side walls with openings disposed therethrough and also providing a strap attached to the top wall;

securing the anchor member upon a slab of heavy solid material; and lifting and moving the anchor member and the slab of heavy solid material.

7. The method of using the universal slab removal device as described in claim 6, wherein the securing the anchor member includes inserting self-setting concrete anchors into the holes of the anchor member and into the slab of heavy solid material.

8. The method of using a universal slab removal device as described in claim 6, wherein the lifting and moving the anchor member includes inserting forks of a fork lift through the openings in the side walls of the anchor member and using the fork lift to lift and move the anchor member and the slab of heavy solid material.

9. The method of using a universal slab removal device as described in claim 6, wherein the lifting and moving the anchor member includes connecting the strap to a lifting apparatus and using the lifting apparatus to raise and move the anchor member and the slab of heavy solid material.

* * * * *